US006941874B2

(12) United States Patent
Huss et al.

(10) Patent No.: US 6,941,874 B2
(45) Date of Patent: Sep. 13, 2005

(54) SYSTEM FOR PREVENTING THE INTRUSION OF A WINDOW INTO A RAIL VEHICLE CAB IN THE EVENT OF AN IMPACT

(75) Inventors: Pierre Huss, Ohlungen (FR); Patrick Sicot, Niederbronn les Bains (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/437,969

(22) Filed: May 15, 2003

(65) Prior Publication Data

US 2003/0221584 A1 Dec. 4, 2003

(30) Foreign Application Priority Data

May 31, 2002 (FR) ..... 02 06708

(51) Int. Cl.[7] ..... B60R 21/00
(52) U.S. Cl. ..... 105/394; 105/456; 280/748
(58) Field of Search ..... 105/394, 392.5, 105/456; 280/734, 748, 749, 751, 753; 49/9, 460, 207

(56) References Cited

U.S. PATENT DOCUMENTS

| | | | | | |
|---|---|---|---|---|---|
| 2,854,281 | A | * | 9/1958 | Cassin | 280/753 |
| 2,933,343 | A | * | 4/1960 | Potts | 280/749 |
| 3,037,809 | A | * | 6/1962 | Praha | 280/749 |
| 3,721,468 | A | * | 3/1973 | Burgess | 280/753 |
| 4,053,180 | A | * | 10/1977 | White | 296/97.6 |
| 6,508,487 | B2 | * | 1/2003 | Koster | 280/730.2 |

FOREIGN PATENT DOCUMENTS

| | | |
|---|---|---|
| DE | 198 51 469 A | 5/2000 |
| DE | 198 52 518 A | 5/2000 |
| DE | 199 37 461 A | 2/2001 |
| FR | 2 818 225 A | 6/2002 |

* cited by examiner

*Primary Examiner*—Mark T. Le
(74) *Attorney, Agent, or Firm*—Sughrue Mion, PLLC

(57) ABSTRACT

To prevent a window intruding into a cab of a rail vehicle in the event of an impact, the vehicle including a protective structure between the window and the interior of the cab and the protective structure including an opening facing the window, the protective structure supports anti-intrusion members which can move to obstruct at least part of the opening.

34 Claims, 5 Drawing Sheets

SYSTEM FOR PREVENTING THE INTRUSION OF A WINDOW INTO A RAIL VEHICLE CAB IN THE EVENT OF AN IMPACT

BACKGROUND OF THE INVENTION

1. Field of the Invention

The invention relates to the construction of vehicles, especially rail vehicles, and provides a system to prevent a window intruding into a cab in the event of an impact and a vehicle including the system.

2. Description of the Prior Art

Rail vehicles usually have a driver's cab with a windshield fixed to a skin constituting the esthetic envelope of the vehicle, providing a windshield/body connection with good aerodynamics. However, the skin has a structure that is not designed to resist major impacts, the rigidity of the vehicle being provided by an independent structure, so that in the event of a violent impact with an obstacle that breaks the skin, the windshield is projected into the driver's cab, endangering the life of the driver.

An object of the present invention is to alleviate these problems by proposing a simple and economical system to prevent a windshield intruding into a cab of a rail vehicle in the event of an impact.

SUMMARY OF THE INVENTION

To this end, the invention provides a system for preventing a window intruding into a cab of a rail vehicle in the event of an impact, the vehicle including a protective structure between the window and the interior of the cab, and the protective structure including an opening facing the window, in which system the protective structure supports anti-intrusion members adapted to move to obstruct at least part of the opening.

Particular embodiments of the above system for preventing a windshield intruding into a rail vehicle cab can have one or more of the following features, in isolation or in any technically feasible combination:

- the anti-intrusion members are moved on command before an impact;
- the anti-intrusion members are moved in the event of an impact, the movement of the anti-intrusion members being caused by the window being pushed in the direction of the cab;
- the protective structure supports programmed-deformation energy-absorbing members between the window and the protective structure;
- the deformation of the energy-absorbing members in the event of an impact causes the anti-intrusion members to move in front of the opening;
- the energy-absorbing members have a face adapted to come into contact with the window and the anti-intrusion members comprise flaps which are attached to the energy-absorbing members in a position that does not initially obstruct the opening, the energy-absorbing members having a shape such that, when they are deformed, the flaps are moved and oriented toward the opening in order to obstruct it partially;
- the energy-absorbing members are trapezoidal-section deformable structures having a longer base bearing on the perimeter of the opening and a shorter base in the vicinity of an edge region of the window, the flap being attached to the deformable structure in the vicinity of the window and having a free edge bearing on the edge of the opening;
- the anti-intrusion members comprise at least one pre-stressed cylinder having a base connected to the protective structure, the cylinder having a sliding rod provided with a head retained at the edge of the opening by locking means, the locking means reacting in the event of an impact to the window by releasing the head of the sliding rod of the cylinder and enabling it to expand in front of the opening;
- the anti-intrusion members are elastic members stretched between points on the protective structure on two different sides of the opening, each elastic member being tensioned parallel to the adjacent edge of the opening by one or more retaining members;
- the surface area of the opening is substantially equal to the surface area of the window.

The invention also provides a rail vehicle including a cab provided with a window, characterized in that it includes a system according to the characteristics previously described for preventing intrusion of the window into the cab.

Objects, aspects and advantages of the present invention will be understood better from the following description of embodiments of the invention, which are offered by way of non-limiting example, the description referring to the accompanying drawings.

DETAILED DESCRIPTION OF THE PREFERRED EMBODIMENTS

To facilitate reading the drawings, only the elements necessary for understanding the invention are shown. The same elements are identified by the same reference numbers from one figure to another.

Figure 1:
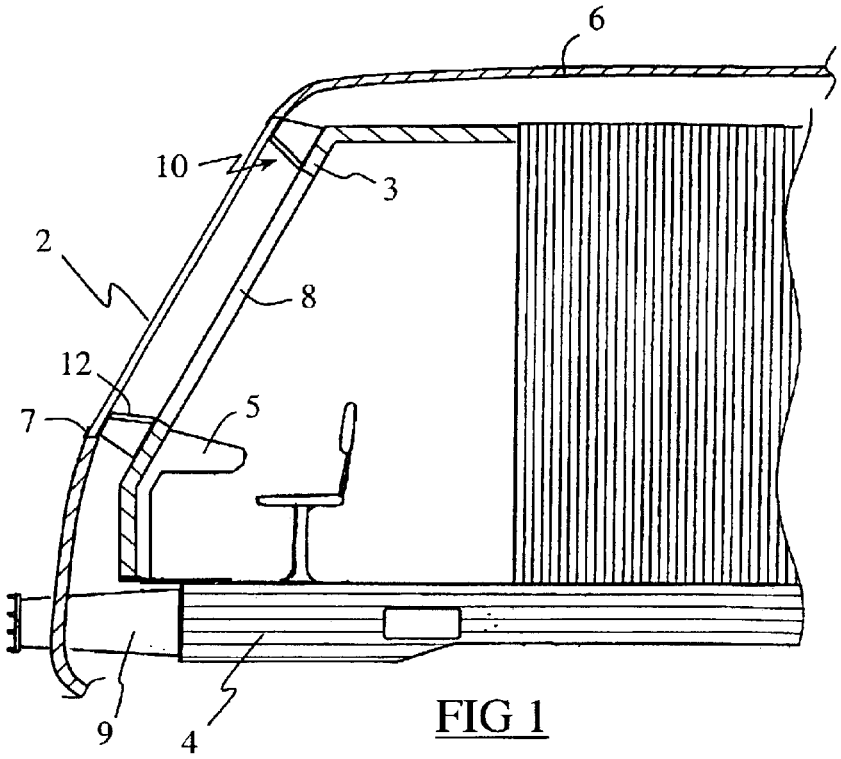
FIG. 1 is a view in longitudinal section of a rail vehicle equipped with a first embodiment of a system in accordance with the invention for preventing a windshield intruding into a driver's cab.

FIG. 1 represents a rail vehicle having a skin 6 constituting the esthetic envelope of the vehicle and a rigid chassis 4 which has an energy-absorbing member 9 at the front end. The skin 6 has a front face incorporating a laminated windshield 2 fixed flush to the skin 6, for example by means of a plastics material shell 7.

As shown in FIG. 1, the vehicle includes a driver's cab 1 to the rear of the front face of the vehicle and including a control console 5 near the bottom edge of the windshield 2 of the vehicle and a driver's seat facing the console. The vehicle also incorporates a system for preventing the windshield 2 intruding into the cab 1, the system including a protective shield 3 between the front face of the vehicle, formed by the skin 6 of the vehicle, and the interior of the driver's cab 1, the protective shield 3 being supported by the chassis 4.

Figure 2:
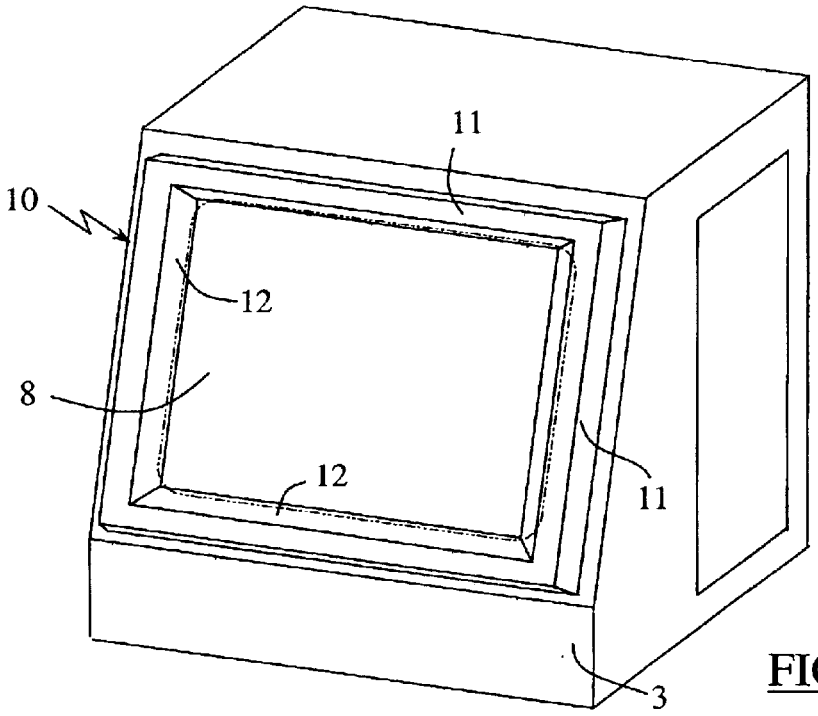
FIGS. 2 and 4 are perspective views of a driver's cab fitted with the FIG. 1 system, respectively before and after an impact.

As shown in FIG. 2, the protective shield 3 takes the form of a metal structure supporting an undeformable rigid front wall extending the full height of the driver's cab 1 and incorporating a rectangular opening 8 facing the windshield 2 of the vehicle, the opening 8 enabling the driver to see out and having a surface area substantially equal to the surface area of the windshield 2. The protective shield 3 also has two lateral walls with an opening in one to enable driver access.

Figure 3:
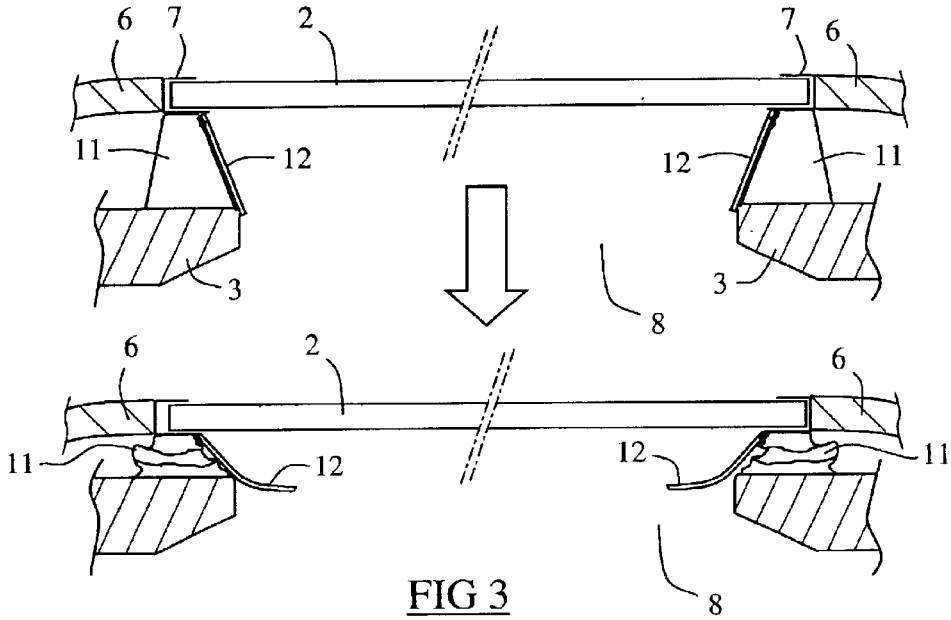
FIG. 3 is a part-sectional view showing the FIG. 1 intrusion prevention system before and after an impact.

The shield 3 supports an energy-absorbing frame 10 around the opening 8 comprising four programmed deformation structures 11 parallel to the respective edges of the opening 8. In the upper diagram in FIG. 3, showing the system before an impact, each deformable structure 11 has a trapezoidal section with a longer base resting on the rim of the opening and a smaller base coming into contact with an edge portion of the windshield 2. The inside edge of each deformable structure 11 supports a flap 12 oriented toward the opening 8 and consisting of a metal plate with one edge welded to the deformable structure 11 near the windshield 2; its other edge is a free edge and rests on the edge of the opening 8, projecting a very small distance inside it.

Figure 4:
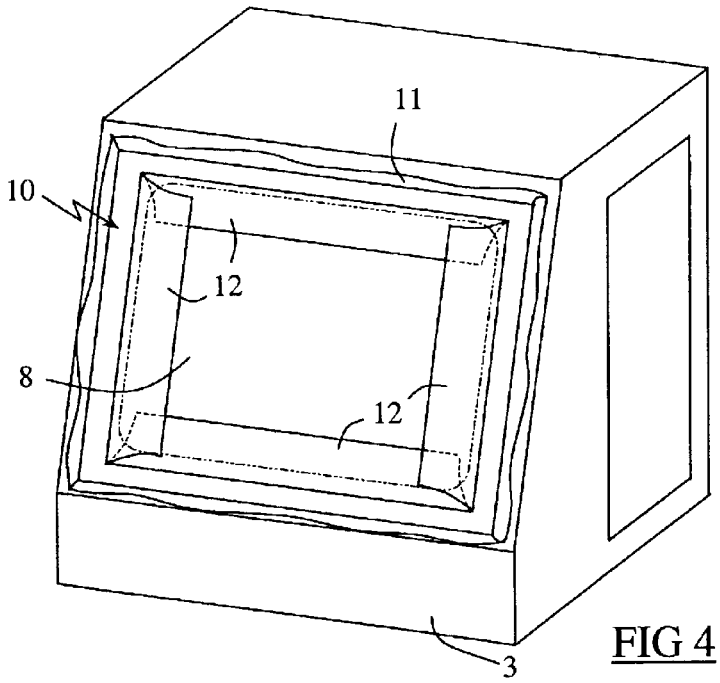

The bottom diagram in FIG. 3 and FIG. 4 show the condition of the system for preventing intrusion of the windshield 2 after an impact that has caused the windshield 2 to be projected in the direction of the cab 1, for example by smashing the plastics material shell 7 retaining it. In these diagrams, when the windshield 2 is projected in the direction of the cab 1, the edges of the windshield 2 bearing against the frame 10 deform the structures 11, thereby deforming the flaps 12 and bending them toward the inside of the opening 8, so that they then partly obstruct the opening 8, thereby limiting the risk of intrusion of the windshield 2 into the driver's cab 1.

It follows from the foregoing description that the risk of intrusion of the windshield or other objects into the cab are minimized, on the one hand, by absorbing a portion of the intrusion energy of the windshield on deformation of the frame and, on the other hand, by the obstructing of the opening by the flaps.

Figure 5:
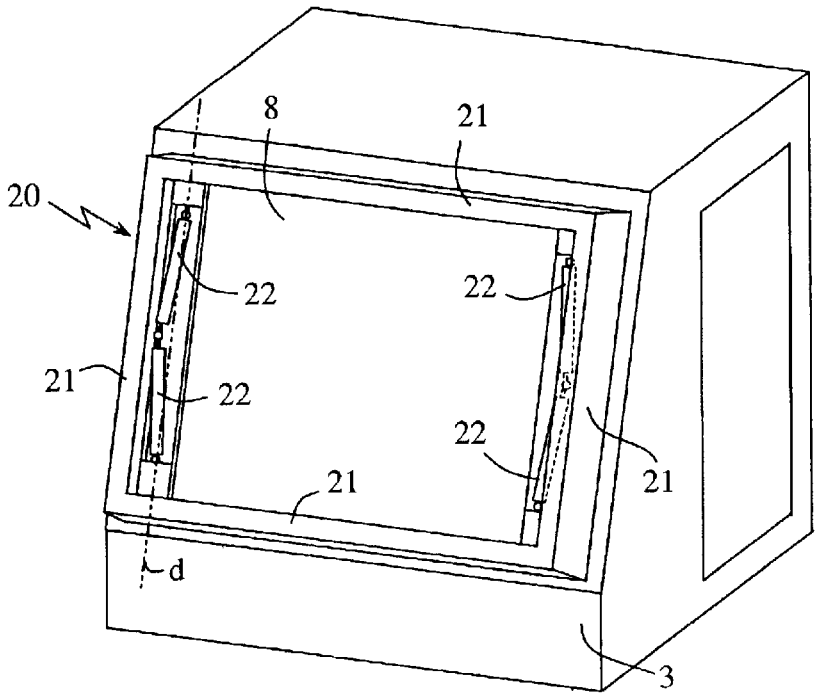
FIG. 5 is a perspective view of a driver's cab structure fitted with a different embodiment of a system according to the invention for preventing intrusion of a windshield.
Figure 6:
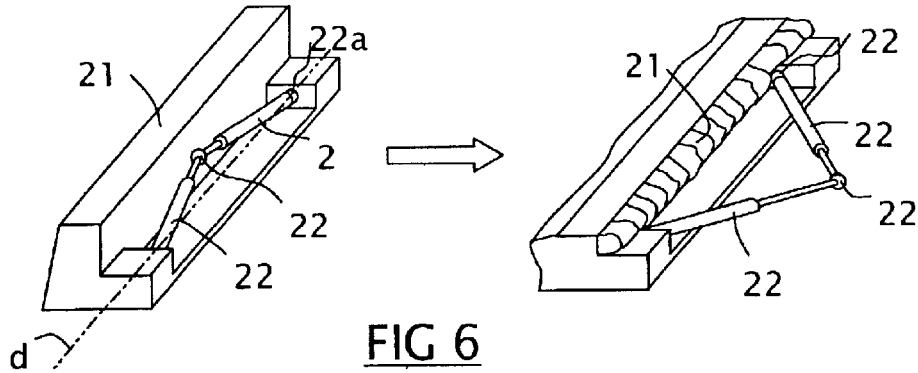
FIG. 6 is a detail view showing the operation of the FIG. 5 system.
Figure 7:
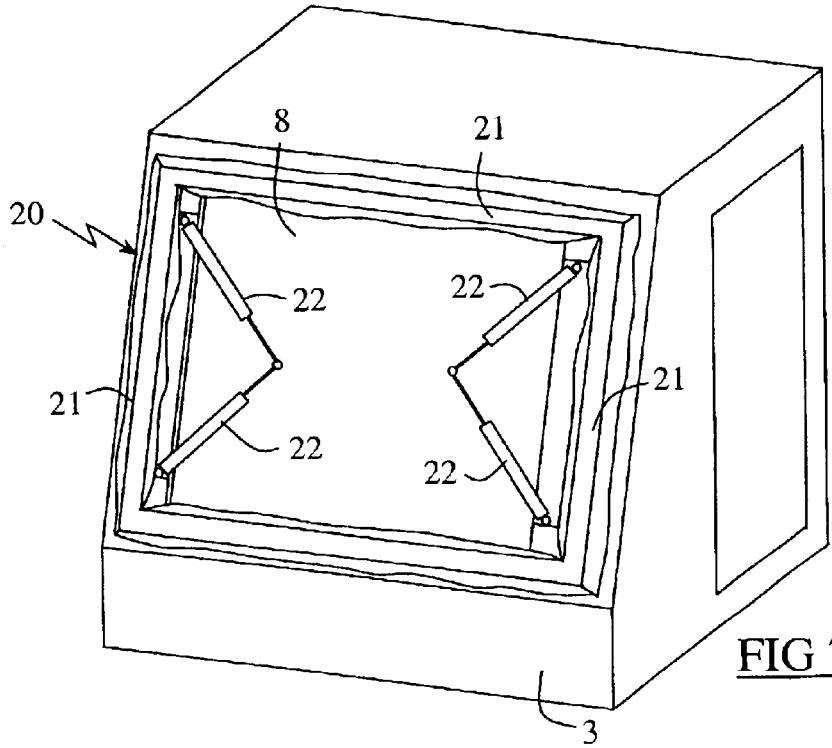
FIG. 7 is a perspective view of the FIG. 5 system after an impact.

FIGS. 5 to 7 show a different embodiment of a system in accordance with the invention for preventing the intrusion of a windshield, in which the frame previously described is replaced with an energy-absorbing frame 20 provided with anti-intrusion means comprising two pairs of prestressed cylinders 22 at the edge of the opening 8.

In FIG. 5 and in the lefthand diagram in FIG. 6, the frame 20 comprises a rectangular frame around the opening 8 with a lower face bearing on the protective shield 3 and a deformable upper portion projecting toward the windshield 2. The upper portion of the frame 20 takes the form of a deformable structure 21 extending around the exterior perimeter of the frame 20 and has an upper face coming into contact with an edge region of the windshield, which is not shown in FIGS. 5 and 6. The frame 20 has, near two opposite edges of the opening 8, two prestressed cylinders 22 disposed head-to-tail and parallel to the edge of the opening 8; each cylinder 22 has a base articulated to the frame 20 by means of a pivot 22*a* allowing the cylinder 22 to rotate in the plane of the opening 8, and the cylinder 22 includes a sliding rod with a head connected by a ball-joint 22*b* to the head of the sliding rod of the opposite cylinder 22. The cylinders 22 positioned in this way are prestressed and have their head abutted against a flank of the closest deformable structure 21, with the heads slightly offset relative to an axis d passing through the bases of the two cylinders 22.

As shown in the righthand diagram in FIG. 6 and in FIG. 7, in the event of an impact causing displacement of the windshield 2 in the direction of the cab 1, the energy of the impact is partly absorbed by deformation of the deformable structures 21; the deformation of the structures 21 simultaneously causes lateral displacement of the heads of the cylinders 22 in the direction of the opening 8, beyond the axis d, causing sudden expansion of the prestressed cylinders 22 in front of the opening 8. The expanded cylinders 22 then prevent intrusion of the windshield 2 into the cab 1.

This variant of the system for preventing intrusion has the advantage that the cylinders expand a long way in the direction of the inside of the opening, commensurately reducing the size of the opening and making the system highly effective.

Figure 8:
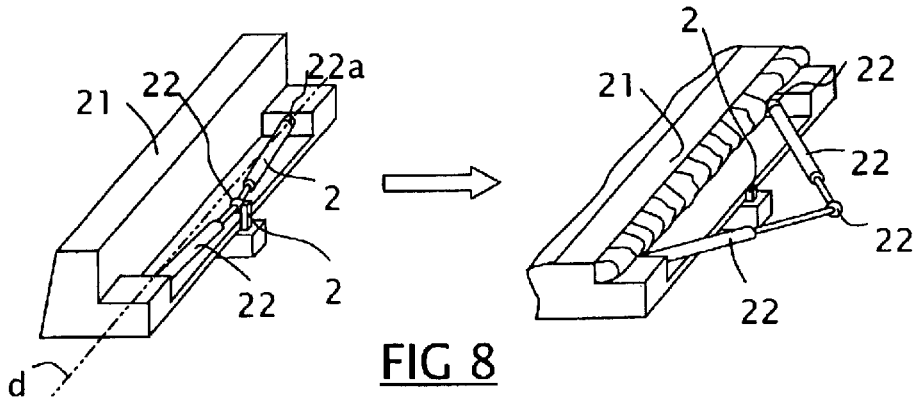
FIG. 8 is a view similar to FIG. 6 of a different embodiment of the FIG. 5 system.

FIG. 8 shows an improved variant of the system previously described in which the cylinders 22 are immobilized along the edge of the opening 8 by selectively operable locking means such as a lug 23 adapted to be moved in translation by an electric motor. The lug 23 is between the axis d and the opening 8 and provides an abutment for the heads 22*b* of the cylinders 22. The electric motor retracts the lug 23 to allow the cylinders 22 to expand in front of the opening 8, either at the command of the driver, via the control console 5, or automatically, via impact sensors. This variant has the advantage that the anti-intrusion cylinders 22 can be released at the command of the driver, for example in anticipation of an impact.

Figure 9:
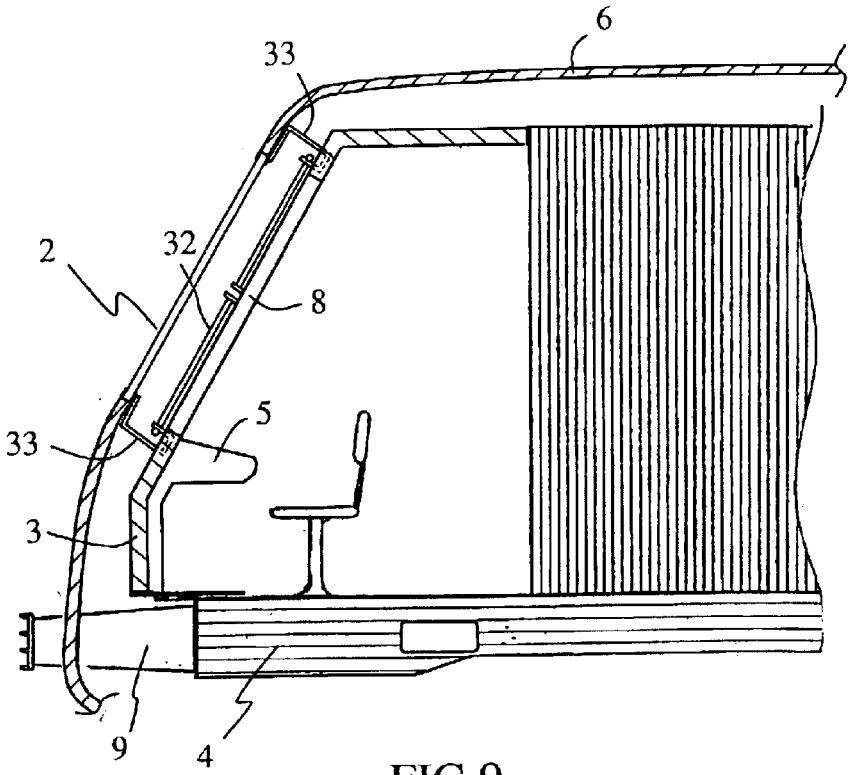
FIG. 9 is a view in longitudinal section of a rail vehicle equipped with a different embodiment of an intrusion prevention system according to the invention.
Figure 10:
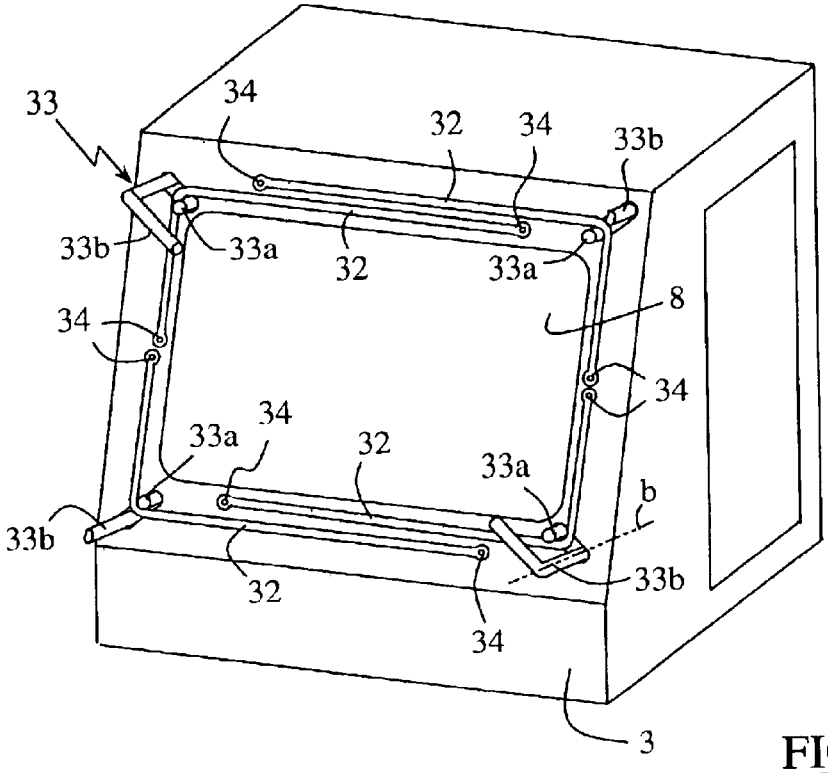
FIGS. 10 and 11 are perspective views of a driver's cab fitted with the FIG. 9 system, respectively before and after an impact.
Figure 11:
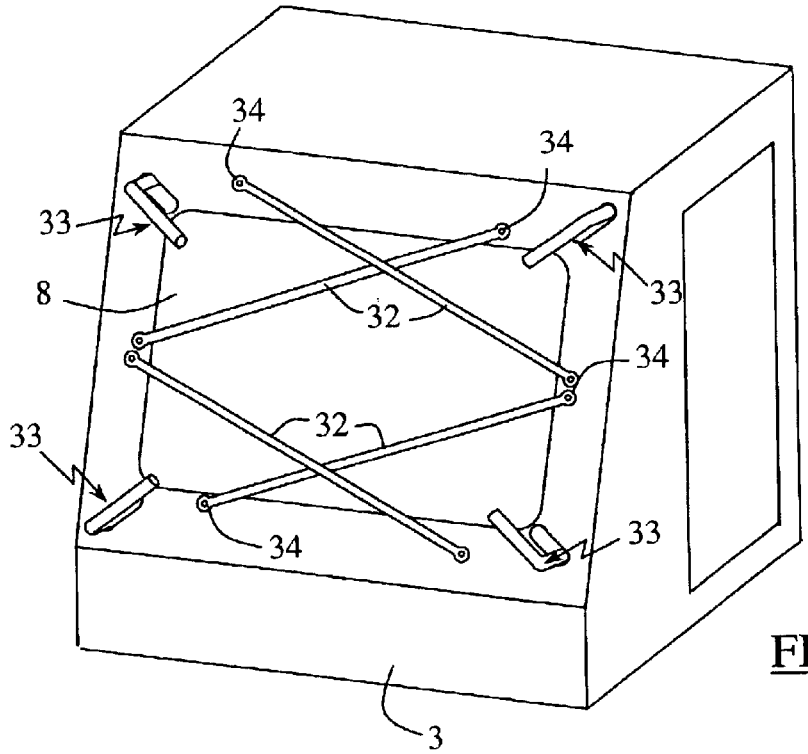

FIGS. 9 to 11 show a further embodiment of a system in accordance with the invention for preventing the intrusion of a windshield. In this embodiment, the driver's cab 1, the chassis 4 of the vehicle, the energy-absorbing members 9, the skin 6 and the windshield 2 are identical to those described with reference to FIG. 1.

In FIG. 10, the vehicle includes a protective shield 3 similar to that previously described but which supports four elastic filaments 32 distributed regularly around the opening 8. Each elastic filament 32 is tensioned between two anchor points 34 on the shield on two adjoining sides of the opening 8 and the filaments 32 are strongly tensioned, substantially parallel to the adjacent edge of the opening 8, by a retaining claw 33 in the corner common to the two edges receiving the anchor points 34. The claws 33 are mounted in the shield 3 through a housing enabling the claw 33 to be moved forcibly along an axis b perpendicular to the windshield 2. Each retaining claw 33 includes a finger 33*a* for retaining the elastic filament 32 and a transmission strut 32*b* extending along the axis b. A bent end of the transmission strut 33*b* of each claw, shown partly cut away for two of the claws in FIG. 10, comes into contact with the windshield 2, while the retaining finger 33*a* is interrupted in the direction of the windshield 2 in order to release the filament 32 if the claw 33 is pushed inside its housing.

Accordingly, as shown in FIG. 11, in the event of an impact causing displacement of the windshield in the direction of the opening 8, the claws 33 are pushed inside their housing, because the windshield 2 bears on the struts 33*b*, and this retracts the retaining fingers 33*a* inside the housing and suddenly releases the elastic filaments 32, which partially relax and assume a position across the opening 8, so limiting the risk of intrusion of the windshield 2 into the cab 3.

In an improved variant of the embodiment previously described, the four claws 33 are advantageously fastened together by connecting rods so that a thrust exerted on only one of the claws 33 pushes in all of the claws 33 and simultaneously releases the four elastic filaments 32.

In another improved variant of the embodiment previously described, the four claws 33 are moved in translation along the axis b by actuators, such as pneumatic cylinders, to release the elastic filaments ahead of time if an impact is predicted, for example at the command of the driver, via the control console 5, or automatically, via sensors on the vehicle.

Of course, the invention is in no way limited to the embodiments described and shown, which are offered by way of example only, and can be modified without departing from the scope of protection of the invention, in particular from the point of view of the composition of the various component parts or by substituting technical equivalents.

Accordingly, in one embodiment the protective shield could be a metal grid.

Thus, although the embodiments previously described represent a system for preventing the intrusion of a windshield into a driver's cab, the system according to the invention can equally well be used to prevent the intrusion of a side window into a cab.

What is claimed is:

1. A system for preventing a window from intruding into a cab of a rail vehicle in the event of an impact, said vehicle comprising:

a protective structure between said window and the interior of said cab, said protective structure including an opening facing said window, wherein said protective structure supports anti-intrusion members that are stored within said protective structure prior to an impact, and extend toward each other in said opening after impact.

2. The system claimed in claim 1 for preventing the intrusion of a window, wherein said anti-intrusion members are moved on command before an impact.

3. The system claimed in claim 1 for preventing the intrusion of a window, wherein said anti-intrusion members are moved in the event of an impact, the movement of said anti-intrusion members being caused by said window being pushed in the direction of said cab.

4. The system claimed in claim 1 for preventing the intrusion of a window, wherein said protective structure supports programmed-deformation energy-absorbing members between said window and said protective structure.

5. The system claimed in claim 4 for preventing the intrusion of a window, wherein deformation of said energy-absorbing members in the event of an impact causes said anti-intrusion members to move in front of said opening.

6. The system claimed in claim 5 for preventing the intrusion of a window, wherein said energy-absorbing members have a face adapted to come into contact with said window and said anti-intrusion members comprise flaps which are attached to said energy-absorbing members in a position that does not initially obstruct said opening, said energy-absorbing members having a shape such that, when they are deformed, said flaps are moved and oriented toward said opening in order to obstruct it partially.

7. The system claimed in claim 6 for preventing the intrusion of a window, wherein said energy-absorbing members are trapezoidal-section deformable structures having a longer base bearing on the perimeter of said opening and a shorter base in the vicinity of an edge region of said window, said flaps being attached to said energy-absorbing members in the vicinity of said window and having a free edge bearing on the edge of said opening.

8. The system claimed in claim 1 for preventing the intrusion of a window, wherein said anti-intrusion members comprise at least one prestressed cylinder having a base connected to said protective structure, said cylinder having a sliding rod provided with a head retained at the edge of said opening by locking means, and said locking means reacting in the event of an impact to said window by releasing said head of said sliding rod of said cylinder and enabling it to expand in front of said opening.

9. The system claimed in claim 1 for preventing the intrusion of a window, wherein said anti-intrusion members are elastic members stretched between points on said protective structure on two different sides of said opening, each elastic member being tensioned parallel to the adjacent edge of said opening by one or more retaining members.

10. The system claimed in claim 1 for preventing the intrusion of a window, wherein the surface area of said opening is substantially equal to the surface area of said window.

11. The system claimed in claim 1, wherein said anti-intrusion members are mounted on opposite sides of said opening.

12. The system claimed in claim 1, wherein said anti-intrusion members are mounted on each side of said opening.

13. The system claimed in claim 1, wherein said anti-intrusion members obstruct a first area of the opening after the impact, and the first area is less than a second area of the opening which is unobstructed.

14. The system claimed in claim 1, wherein, after said impact, a portion of said window remains unobstructed between said anti-intrusion members.

15. A rail vehicle including a cab provided with a window, which vehicle includes a system as claimed in claim 1 for preventing intrusion of said window into said cab.

16. A system for preventing a window from intruding into an interior of a cab of a rail vehicle in the event of an impact, comprising:

a protective structure, arranged between said window and said interior of said cab, comprising an opening facing said window; and anti-intrusion members supported by said protective structure wherein said anti-intrusion members are stored within said protective structure prior to an impact, and extend toward each other in said opening after impact.

17. The system claimed in claim 16, wherein said anti-intrusion members are extended on command before an impact.

18. The system claimed in claim 16, wherein said anti-intrusion members are extended during the impact by said window being pushed in the direction of said cab.

19. The system claimed in claim 16, further comprising programmed-deformation energy-absorbing members between said window and said protective structure.

20. The system claimed in claim 19, wherein deformation of said programmed energy-absorbing members during an impact causes said anti-intrusion members to extend into said opening.

21. The system claimed in claim 20, wherein:

each of said programmed energy-absorbing members comprise a first face adapted to come into contact with said window;

each of said anti-intrusion members comprise flaps movably attached to said energy-absorbing members;

when said flaps are in a first position before an impact, so that they do not initially obstruct said opening; and during an impact, said flaps are extended into said opening by said deformation of said programmed energy-absorbing members.

22. The system claimed in claim 21, wherein:

said programmed energy-absorbing members further comprise a second side adapted to contact said protective member, wherein the second side is wider than the first side so that the programmed energy-absorbing members are trapezoidal in cross section, said flaps comprise a first edge attached to said programmed energy-absorbing members in the vicinity of said window and a second edge near said opening which is free.

23. The system claimed in claim 16, wherein:

said anti-intrusion members comprise at least one prestressed cylinder having a base connected to said protective structure, said cylinder comprising a sliding rod provided with a head retained at the edge of said opening by locking means, and said locking means releases said head of said sliding rod of said cylinder during an impact, enabling it to expand in front of said opening.

24. The system claimed in claim 16, wherein:

said anti-intrusion members are elastic members stretched between points on said protective structure on two different sides of said opening, each elastic member being tensioned parallel to the adjacent edge of said opening by one or more retaining members.

25. The system claimed in claim 16, wherein the surface area of said opening is substantially equal to the surface area of said window.

26. A rail vehicle including a cab provided with a window, the vehicle comprises a system as claimed in claim 16, for preventing intrusion of said window into said cab.

27. The system claimed in claim 16, wherein said anti-intrusion members are mounted on opposite sides of said opening.

28. The system claimed in claim 16, wherein said anti-intrusion members are mounted on each side of said opening.

29. The system claimed in claim 16, wherein said anti-intrusion members obstruct a first area of the opening after extending therein after the impact, and the first area is less than a second area of the opening which is unobstructed.

30. The system claimed in claim 12, wherein, after said impact, a portion of said window remains unobstructed between said anti-intrusion members.

31. A system for preventing a window from intruding into a cab of a rail vehicle in the event of an impact, said vehicle comprising:

a protective structure between said window and the interior of said cab, said protective structure including an opening facing said window, wherein said protective structure supports anti-intrusion members adapted to move to obstruct at least part of said opening, wherein said anti-intrusion members are moved in the event of an impact, the movement of said anti-intrusion members being caused by said window being pushed in the direction of said cab.

32. A system for preventing a window from intruding into a cab of a rail vehicle in the event of an impact, said vehicle comprising:

a protective structure between said window and the interior of said cab, said protective structure including an opening facing said window, wherein said protective structure supports anti-intrusion members adapted to move to obstruct at least part of said opening, wherein said anti-intrusion members comprise at least one prestressed cylinder having a base connected to said protective structure, said cylinder having a sliding rod provided with a head retained at the edge of said opening by locking means, and said locking means reacting in the event of an impact to said window by releasing said head of said sliding rod of said cylinder and enabling it to expand in front of said opening.

33. A system for preventing a window from intruding into an interior of a cab of a rail vehicle in the event of an impact, comprising:

a protective structure, arranged between said window and said interior of said cab comprising an opening facing said window; and anti-intrusion members supported by said protective structure so as to partially extend into said opening during the impact, wherein said anti-intrusion members are extended during the impact by said window being pushed in the direction of said cab.

34. A system for preventing a window from intruding into an interior of a cab of a rail vehicle in the event of an impact, comprising:

a protective structure, arranged between said window and said interior of said cab comprising an opening facing said window; and anti-intrusion members supported by said protective structure so as to partially extend into said opening during the impact, wherein:

said anti-intrusion members comprise at least one prestressed cylinder having a base connected to said protective structure, said cylinder comprising a sliding rod provided with a head retained at the edge of said opening by locking means, and said locking means releases said head of said sliding rod of said cylinder during an impact, enabling it to expand in front of said opening.

* * * * *